United States Patent [19]

Reuting et al.

[11] 4,050,043

[45] Sept. 20, 1977

[54] ELECTROMAGNETIC SYSTEM

[75] Inventors: Hans-Werner Reuting, Peine; Hugo Eggers, Eltze, both of Germany

[73] Assignee: Elmeg Elektro-Mechanik GmbH, Peine, Germany

[21] Appl. No.: 536,436

[22] Filed: Dec. 26, 1974

[30] Foreign Application Priority Data

Dec. 29, 1973 Germany ..... 2365190

[51] Int. Cl.[2] ..... H01F 7/08

[52] U.S. Cl. ..... 335/237; 335/234; 335/236

[58] Field of Search ..... 335/179, 229, 236, 237, 335/230, 234, 79, 81, 181, 137, 128, 304; 310/317

[56] References Cited

U.S. PATENT DOCUMENTS 2,511,114 6/1950 Lavery ..... 175/339

3,441,883 4/1969 Alletru ..... 335/236 X

FOREIGN PATENT DOCUMENTS 251,682 1/1967 Austria ..... 335/236

*Primary Examiner*—Harold Broome

*Attorney, Agent, or Firm*—Ralf H. Siegemund

[57] ABSTRACT

A system for a relay is disclosed having a permanent magnet for bias and electromagnetic energization for changing the disposition of an armature. A magnetic shunt path is provided for the permanent magnet serving as a basic load on the magnet, in that the magnetic resistance of magnet plus parallel shunt is lower than the resistance of the remainder of the magnetic circuit. The shunt has preferably resistance that declines with field strength and the flux at the work point (external excitation zero) plus field as set up by the magnet times its permeability should exceed 6000 Gauss.

14 Claims, 6 Drawing Figures

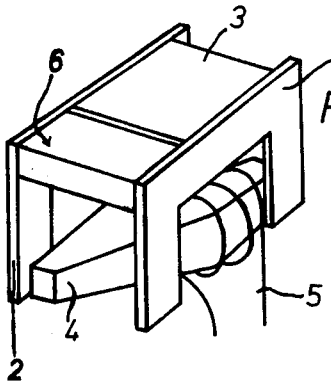
Fig.1
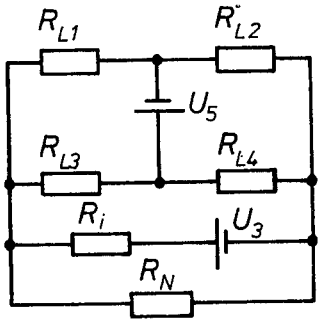
Fig.2
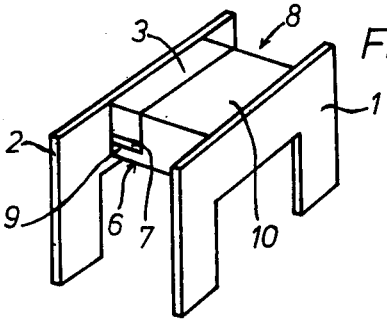
Fig. 3
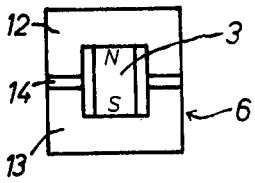
Fig.5
Fig. 6
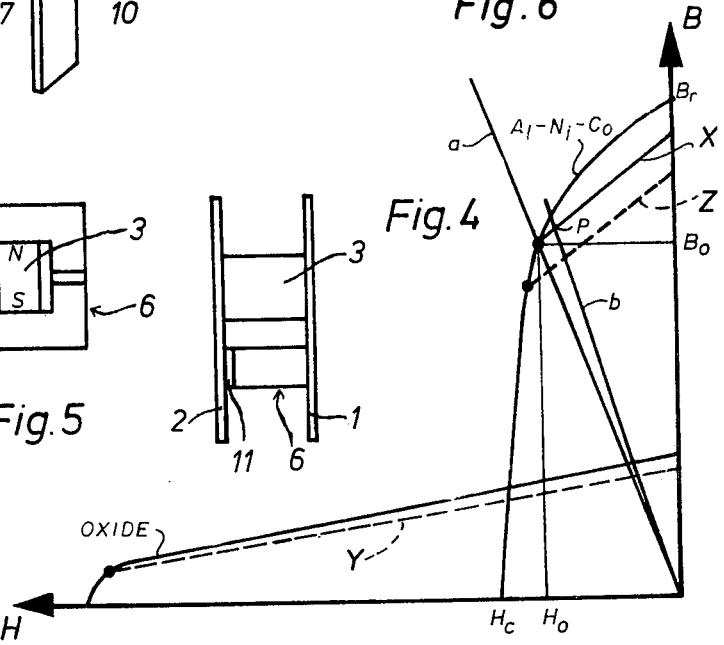
Fig. 4

ELECTROMAGNETIC SYSTEM

BACKGROUND OF THE INVENTION

The present invention relates to improvements in electromagnet systems which include a permanent magnet and a parallel connected shunt path of magnetically conductive material.

Electromagnet systems for instance, of the type used in electromagnetic relays, usually have permanent magnets of comparatively large internal resistance, if regarded as sources of magnetic potential. Consequently, the magnetic potential varies at loading and unloading, for example, due to variations of the air gap between the yoke and armature of the magnet. This potential varies also if an external excitation is superimposed for switching the relay. Such a non-constant magnetic potential leads generally to deterioration of the working characteristic of the relay, and in many instances (i.e. over excitation) the relay-characteristic may shift irreversibly.

It is not possible to maintain a constant magnetic potential with conventional means, because permanent magnets have permeability values which correspond nearly to that of air, or are four to five time higher than that of air.

Such magnets possess the quality that their magnetic potential at the polefaces actually drops considerably during loading, i.e. when the armature approaches the pole shoe and/or during superimposing of an excitation flux acting in the same direction as the permanent flux. In other words, the magnetic flux does not increase as nearly proportionally as it could be expected to do. This holds even more for the forces acting on the armature which vary with the square of the magnetic flux value. Such a non-constant magnetic potential is utilized deliberately in some known relay designs in order to obtain a small pick-up excitation in the working airgap and a linear characteristic for the force of the permanent magnet as acting on the armature. However, the sensitivity of the relay is much decreased, and the major portion of the superimposed external excitation is actually shifted from the working airgap — where it is predominantly needed — to the permanent magnets for their magnetization.

It should be mentioned that electromagnetic relays are known wherein the electromagnet system includes a permanent magnet and a parallel connected shunt made of magnetically conductive material. The shunts used, however, are auxiliary shunts which are not provided for diverting large porportions of the permanent flux. They are, therefore, unsuitable for achieving a constant magnetic potential. They serve only for trimming and adjusting purposes, to compensate for variations in the properties of the components employed, manufacturing tolerances etc.

DESCRIPTION OF THE INVENTION

It is an object of the present invention to provide for a new and improved magnet system particularly but not exclusively for electromagnetic relays with permanent magnetic energization.

In accordance with the preferred embodiment of the invention it is suggested to provide a magnetic resistance in magnetically parallel relation to a permanent magnet, wherein the internal magnetic resistance of the permanent magnet and of the shunt, taken together, is smaller than the respective resultant of all the remaining magnet resistances of the magnet system, including particularly the magnetic resistances through a movable member such as an armature and any airgap.

Thus, a highly constant magnetic potential is made available for application to such a movable member which will be affected only to a negligible degree by variations of and in the working airgap. Such variations result from armature movement in the gap, or because of other influences such as external excitation or similar cause. A magnet system with a highly stable working point is thus obtained. Moreover, the degree of constancy of the magnetic potential depends, of course, on the ratio of the magnetic resistance of the magnet system of other than permanent magnet and shunt, to the magnetic resistance of the parallel connection of permanent magnet and shunt. The resistance of the shunt may, for instance, amount to one-fifth or even be one or several orders of magnitudes smaller than the sum total of all the remaining magnetic resistances in the system. As the magnetic system works at a practically constant permanent magnetic potential or magneto-motive force, it has particular advantages for example over the known relays. In the case of very strong external excitations known relays incur always changes of the working points of the permanent magnet. Moreover, even changes in magnetic polarity had to be considered a definite possibility.

The permanent magnet and its shunt in accordance with the invention represent a parallel magnetic circuit connection with very small resistance for the externally excited flux. Consequently, almost the entire magneto-motive force of excitation is available at the working airgap which appears in series with the magnetic parallel circuit. Thus, the resulting relay system is of very high sensitivity because the exciting magneto-motive force is almost fully utilized for position change of the armature and is not dissipated for magnetizing the permanent magnets and/or into weak shunt paths.

A particular advantage is achieved in the new electromagnet-system in that the permanent magnet can be magnetized separately from the electromagnet system, provided that the permanent magnet and the shunt form a closed magnetic circuit external to the relay system.

In the prior art systems, permanent magnets had to be magnetized within the relay assembly, otherwise even bigger disadvantages would have been encountered. If a permanent magnet were magnetized externally to the relay system a field strength value quite close to the coercivity point would be set which deteriorates considerably after fitting the magnet into the rely. In addition, the field strength varies extensively when the working airgap varies. These operational field strengths and potential variations increase considerably if after installation of the externally magnetized permanent magnet an external excitation is applied via the exciter coil. The external excitation produces a flux which runs either in the same direction as or opposite to the flux of the permanent magnet depending on the position of the armature. If the fluxes run in the same direction, the above mentioned field strength and potential variation would be considerably amplified. In the case of oppositely directed fluxes the flux of the permanent magnet can be actually weakened or perhaps over-compensated. Thus, the working point of the demagnetization curve is shifted irreversibly from the coercitivity strength point into negative fluxes, which means pole reversal and the relay is rendered inoperative. These problems were dealt with in the past to some extent by magnetizing the magnet after installation.

According to the described embodiment of the invention, the permanent magnet can be magnetized outside the magnetic system and fitted together afterwards therewith without encountering these problems. The powerful shunt loads the magnet with such strong flux, that any flux in the same or in the opposite direction from and originating with the exciter system are comparatively weak. Thus, neither a noteworthy deterioration of the field strength nor of the operation potential (in case of the same direction) nor a partial or full compensation in the case of oppositely directed force can take place.

A particular advantageous form of the invention can be realized if the magnetic resistance of the working airgap of the electromagnet system, taken by itself, is higher than the entire magnetic resistance of the rest of the magnet system, including permanent magnet and shunt. Upon satisfying these conditions for the construction of the electromagnet system, a constant magnetic potential is available at the working airgap and not only at the parallel network formed by the permanent magnet and shunt.

A very good construction for an electromagent system according to the invention when the shunt is included in a block which has a slot running parallel to the two yokes of the electromagnet system. The permanent magnet is placed into that slot. In this way, the edge or edges of the block rising above the magnet at the sides form a shunt of relatively small cross-section, so that the desired complimentary magnetic resistance is realized without noteworthy additional spacer requirement, while the other part of the block forms practically a magentic short circuit, through which the ends of the magnet are magnetically connected to the yoke, This method of forming the shunt has the advantage that the permanent magnet is effectively screened from the outside.

A solution which is even more favorable with regard to such magnetization and protection of the permanent magnet is achieved by embedding the permanent magnet into a block which serves as the shunt, and lies on the pole surfaces of the permanent magnet, whereof it surrounds at least two side surfaces. The block made of magnetic conductive material can be composed of two U cross-sectional components for instance, which enclose the two branches of a U shaped permanent magnet. The latter therefore is almost fully screened from external influences and forms a closed magnetic circuit with the shunt. The part of the block which abuts the pole surfaces acts as a magnetic short circuit of the magnets to the poles, while the U legs form the actual shunt.

Regular soft iron has a high permeability which depends considerably on the predominant field strength. If used for shunt material, its permeability may increase with decreasing field strength in the region of field strengths used in the magent system. As a consequence of increasing permeability and decreasing resistance of the shunt, the magnetic potential difference across the shunt would break down until a stabilized state is established adjacent to the maximum of the $\mu$ curve. In order to prevent such a drop of the magnetic potential difference, it is proposed as a further development of the invention to provide the shunt with an airgap which determines its magnetic resistance.

The thickness of such an airgap in the shunt must be accurately determined in order to fix its magnetic resistance exactly. Under consideration of a requirement for a relatively simple manufacture, it is proposed that the shunt be made of two parts which are separated from each other by a spacer plate acting as an airgap. Such spacer plates are available on the market for instance in the form of bronze foil rolled to exact thickness, thus enabling the two parts of the shunt to obtain the exact distance from each other after pressing them to the bronze foil; the magnetic resistance of the shunt is determined therewith. At the same time such a spacer plate prevents iron etc. accumulating in the airgap. Dust, particularly when magnetizable, would vary the shunt's characteristic and, therefore would interfere with the exact working characteristic of the magnet system.

Developing the invention further, and in lieu of or in addition to the airgap, it is suggested that the magnetic resistance of the shunt decreases with increasing magnetic field strength. This can be achieved by coordinating the range of field strength necessary for the magnet system and the shunt material and/or dimensioning of the shunt, thus establishing an additional stablilizing effect for the magnetic potential difference. Should the magnetic potential difference increase, for instance, because of external excitation or due to variation of the working airgap, then the shunt reacts with a smaller resistance thus compensating again for the increase in magnetic potential difference. An increasing reistance of the shunt acts also against a break down of operating magnetic potential difference.

It is important for the faultless operations of a magnet system in a relay. that the permanent magnet and its field producing characteristic is accurately and uniformly reproducable during manufacture, so that the magnetic force acting on the armature can be exactly predetermined and maintained. Should the forces be too strong the relay would be insensitive; should they be too weak, the reliability of the relay would be influenced. For these reasons, it may be advantageous to provide a facility for adjusting the magnetic resistance of the shunt after assembling the relay. This provision may take different forms, such as a screw made of material that can be magnetized; the magnetic resistance of the shunt can be altered by adjustment of that screw accordingly. Alternatively, an adjustable airgap within the shunt path may be provided combining the above mentioned airgap function with the possibility of changing the magnetic resistance of the shunt. As a preferred solution however, it is proposed to provide an airgap in series with the shunt which is filled with a (nonmagnetic) foil containing iron particles in varying densities. The foil may, for instance, be comprised of a small plastic plate interspersed with iron powder. This plate can be shifted in the airgap to align differently dense portions with iron powder with the shunt material proper. Thus, shifting of the plastic strip increases or decreases the magnetic resistance of the shunt. Also here accumulation of iron particles in an airgap is prevented, as is necessary for reasons mentioned above.

Application of the shunt according to the invention opens a further way of stabilizing the magnetic potential by selecting the magnetic substances. Thus, extremely favorable results are realized, upon developing the invention further, by choosing for the permanent magnet a material and setting the working point of the demagnetizing curve (Bo;Ho) by operation of the shunt so that the expression $Bo+\mu Ho$) is larger than 8000 Gauss, where Bo is the flux density or induction in the working point and at a magnetic field strength Ho, and $\mu$ is the permeability of the system as a whole at the working point.

The aforementioned conditions can be established, for instance, by choosing an Aluminum-Nickel or Aluminum-Nickel-Cobalt alloy for the permanent magnet. These magnetic materials possess demagnetization curves which exhibit still high flux densities at relatively high field strengths. Such demagnetization curves in connection with powerful shunts allow alterations of other magnetic resistances of the magnet system to result in only minor variations of the magnetic potential difference. At the same time, such alloys possess the advantage of having very small temperature sensitivity with respect to magnetic characteristics, which affects also favorably the stabilization of the magnetic potential.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a perspective view of an electromagnetic relay incorporating a magnet system constructed in accordance with the preferred embodiment of the invention;

FIG. 2 is an equivalent circuit diagram of the magnet system used in the relay shown in FIG. 1;

FIG. 3 is a perspective view of a relay similar to that shown in FIG. 1 in which however, the armature is omitted, and the permanent magnet and the shunt have a modified shape;

FIG. 4 is a side view of a relay similar to those shown in FIG. 1 and FIG. 3, with a modified shunt;

FIG. 5 is a front view of a further modified shunt;

FIG. 6 is a diagram, with reference to which the operational characteristics of a magnet system according to the invention and the optimum choice of the permanent magnet material is explained.

All of the relays shown in the drawings possess U shaped magnet yokes 1 and 2, and a permanent magnet 3 is arranged between their bases in each case. The arms of the yokes define the magnet poles and a magnet armature 4 is positioned inbetween. The armature is mounted in bearings which enable its swinging and pivoting, so that the side adjacent the end surfaces of the armature can abut simultaneously to two diagonally opposite branches of the magnet yokes 1 and 2. Armature 4 is surrounded by a magnet-coil 5 for its excitation, the coil is shown schematically only. Relays as described thus far are known per se and used as polarized relay. As a rule these are bistable relays with a known working characteristics.

According to the preferred embodiment of the invention, the magnet system of these relays is constructed so that in addition to permanent magnets 3 between yokes 1 and 2 in each instance, a magnetic shunt 6 is provided, being made of magnetic material and bridging the permanent magnet at least partly. This shunt causes the magnetic resistance of the combined parallelly connected permanent magnet and shunt to be smaller than the resultant magnetic resistance of the remainder of the magnet system (which includes yokes and armature).

In FIG. 1 permanent magnet 3 extends from one yoke to the other, and the shunt 6 consists here of a bridge which extends physically as well as magnetically, parallelly to permanent magnet 3, particularly connecting magnetically the yokes 1 and 2 in addition to their connection by magnet 3. The specified conditions arising here will be explained below with reference to FIG. 6.

For better understanding, the invention equivalent electrical terms will be introduced. Accordingly, FIG. 2 shows an electrical network which reflects the magnetic relationship of the relay unit shown in FIG. 1 in terms of an electrical circuit. A magnetic excitation "voltage" U5, is generated by the excited solenoid coil 5, and permanent magnet "voltage" U3, which is maintained by the strength of the permanent magnet are depicted as voltage sources. The particular electrical resistance which is connected in series with the voltage source for permanent voltage U3 represents the magnetic internal resistance Ri of this voltage source, and exists because of the permeability and due to actual dimensions of the permanent magnet material.

A further resistance representing magnetic shunt resistance RN corresponding to the permeability of the shunt material 6 and its dimensions, is connected parallelly to internal resistance Ri and the voltage source of voltage U3. Thus, the parallel network composed of the internal resistance R*i* and voltage source with voltage U3 and shunt resistance RN embodies an equivalent circuit for a magnetic "voltage sources" consisting of permanent magnet 3 and shunt 6.

Further resistances RL1 and RL2, RL3 and RL4 are connected parallel to the voltage source U5, which represents the exciting magneto-motive force. These four resistances represent respectively the magnetic resistance of the working airgaps between the two ends of relay armature 4 and the four legs of the magnet yokes 1 and 2. These resistances therefore are variable depending on the position of the armature. The magnetic resistance of the armature itself and of the yokes can be included and distributed as constant components in each of these four "resistors".

This equivalent electric circuit demonstrates that, without a shunt, the magnetic potential would vary considerably during the alterations of the airgap resistances R1 (the same is valid for a too large shunt resistance RN) as a consequence of the rather high internal resistance R*i*. Without a shunt, the externally excited magneto-motive force U5 has to be higher than necessary in the case of the inventive shunt because the externally exerted magneto-motive force would have to overcome the very high internal resistance R*i*. On the other hand, without a shunt, the permanent magnet could be quite easily demagnetized, for instance, upon a slight over excitation. The permanent magnet may not be demagnetized completely, but readily to such an extent than an entirely different working point is being set. Even then the functional data of the relay may be altered so that it will not operate properly or perhaps not at all.

In the case of even stronger over excitation (still without or with too high a shunt) the polarization of the permanent magnet may actually be reversed and that of course would render the relay quite useless. Thus, the known relays which do not have a powerful shunt path, considerably magnetic resistances occur additionally because some soft iron paths of the relay will be driven in the saturated state. As a consequence of the high internal resistance R*i* and of these additional resistances caused by saturation, the magnetic system, i.e. the known relays are rather insensitive.

According to the described embodiment of the invention a magnetic shunt resistance RN is provided which has a smaller value than the actual resultant value of the rest of the magnetic resistances as connected and effective, that is of the airgap resistances R1 and other resistances within the iron path of the magnet system, i.e. the relay. Referring to the circuit diagram shown in FIG. 2 it can be seen that the parallel network composed of R*i*, U3 and RN provides a magnetic potential source which supplies in fact a constant magneto-motive force, which can be affected only to a negligible extent by the alterations of other magnetic resistances ($R_L$) of the magnet system.

This magnetic potential source is certainly the more constant the smaller the shunt resistance RN is in relationship to the rest of the magnetic resistances. Should it be required that this potential reach the working airgap fairly unaltered, care must be taken that the other iron path resistances, particularly that of the armature and yokes are small in relationship to the resistances of the working airgaps. Accordingly, the exciting magneto-motive force U5 is also made available at the working airgaps almost at its full value, because the other path resistances which have to magnetized do not have significant values. This results in the highest possible sensitivity for such a relay.

Instead of shaping the magnetic shunt in the form shown in FIG. 1 it may be constructed as a block 8 (FIG. 3), which is provided with a groove 7 running parallel to yoke 1 and 2 and into which the permanent magnet 3 is laid. Thereby, a small part 9 which extends below the bottom of the permanent magnet 3 forms the actual shunt, while the other part 10 of the block 8 produces practically a magnetic short circuit between permanent magnet 3 and yoke 1. The complete block 8 may be made of iron for example.

Adjustment of the magnetic potential can be achieved by a construction according to FIG. 4, in which the shunt 6 extending between the two yokes 1 and 2 contains an airgap at the lefthand side, and this gap is filled with a sheet 11. Sheet 11 may be made of a plastic plate, for example, which contains iron powder distributed therein in varying density. As plate 11 is shifted within the air gap in a direction in which the iron powder density of the plate increases, the shunt will be increased, while it will decrease in the case of shifting the plate oppositely. Thus, the shunt resistance RN is made variable in a rather simple fashion. In addition the filling of the airgap with foil has the effect that no small iron particles etc. can accumulate within the airgap during operation and can thus alter the working point of the magnetic system.

Another arrangement of connecting a permanent magnet 3 and a shunt in parallel is illustrated in FIG. 5. The shunt is comprised of two elements 12 and 13 each of which having a U-shaped cross-section and embraces the permanent magnet 3 partially; the magnet 3 is arranged on the inside of the space circumscribed by the two elements. The legs of the U-shaped elements 12, 13 are separated by a thin spacer plate 14 made of bronze foil and which creates an airgap; the legs of elements 12, 13 extend along the magnet 3 and along opposite sides thereof. These legs provide the actual shunt while the regions adjoining the pole surfaces of the permanent magnet represent a short circuit between the permanent magnet and adjoining yokes.

The parallel connection of the permanent magnet and shunt shown in FIG. 5 has the advantage that the permanent magnet is almost fully protected and screened, and together with the shunt a closed magnetic circuit is formed which is rather independent of the remainder of the magnetic system, thus making magnetization possible from the outside thereof.

If the distance plate 14 is made of a substance having a permeability which corresponds to that of air and does not depend on the actual field strength, it determines an extremely accurate airgap value which fixes the magnetic resistance of the shunt and ensures that the magnetic potential cannot break down due to dependancy of the permeability being on the field strength. Instead of an airgap in the shunt, a material can be used, the resistance of which decreases with increasing field strength and which thus offsets variation in the magnetic potential. Such material may, for example be any soft iron as commonly used in magnetic circuits. One has to take care, however, that the working point be located above the steepest portion of the magnetization curve. Thus, one needs the premagnetization as furnished by the permanent magnet. All other aspects are resolved by proper proportioning of parts commensurate with the task to be perfomed by the system.

The effect of magnetic characteristics with negative slope can be derived also from FIG. 2. Should the magnetic potential on the parallel network formed by Ri, U3 and RN increase, for example due to changes in the airgap resitance R1 or due to changes of the exciting magneto-motive force U5, then the shunt resistance will decrease because of the material chosen, resulting in a compensation of such a potential increase. A corresponding situation holds true for the case of a decreasing potential on the parallel network.

FIG. 6 shows demagnetizature curves of twice magnetic materials, the flux density or magnetic induction B is plotted on the ordinate, and the abscissa represents the magnetic field strength H. The demagnetization curve of a conventional permanent magnet material (oxide material) which as been used quite often previously in relays is shown, as well as also the demagnetization curve of an aluminum-nickel-cobalt alloy, the latter being the permanent magent material as preferably used for arrangments according to the invention.

The demagnetization curves do not show directly the behavior of the magnet at different loading conditions. Rather, the working or operating point (Bo; Ho) on the demagnetization curve will be established after demagnetization, which in turn is determined by the condition of smallest loading flux.

Initially, the permanent magnet will be magnetized by means of strong fluxes. After removing this magnetization the flux B drops to a value which is determined by any shunt resistance and other existing magnetic resistances.

Upon altering the armature position or applying an external excitation field the actual working point will be shifted, until the smallest flux or magnetization value under any possible operating conditions is reached. During subsequent normal operation, only large fluxes will occur in the permanent magnet. Its field strength will not vary according to the demagnetization curve, but will follow approximately a straight, fully drawn line. That line starts from the lowest working point (B*o*; H*o*) on the demagnetization curve and runs up to an inclination $\Delta B/\Delta H = \mu$ (permeability of the permanent magnet material). Line X extends from that marked working point (Bo; Ho) towards the upper righthand side for the Al-Ni-Co alloy. The dotted straight line Y is the analogous characteristics for the oxide material. The straight lines X and Y however, do not extend to the lefthand side of the respective demagnetization curve either.

As the magnet is unloaded further for one reason or another and the flux is lower than anticipated even for transient causes only, then the working point will be shifted downwards on the demagnetization curve. Accordingly, a new straight working characteristic will be set up, which is plotted as an example by a dotted straight line Z as relating to the Al-Ni-Co material and which runs approximately parallel to the characteristics X, rising also upwards towards the righthand side.

This last phenomenon of dropping of the working point is a serious problem for all known relays, if an excitation is applied which is higher than any of the previous excitations, the working point of the magnet will always be shifted downwards in each instance. Thus, the operational data of the relay are changed irreversibly until making the relay useless. However a completely different relay characteristic will result if the working point is shifted on the demagnetization curve to a value below the abscissa. The demagnetization curve actually extends to values below the abscissa which is not illustrated in FIG. 6.

It will be shown later, that this extremely disadvantageous phenomenon of changing the operational data is almost completely eliminated by the magnet system according to the described embodiment of the invention.

Besides the curves as discussed thus far, a straight line *a* is also plotted in FIG. 6 and this line represents the shunt and shows flux values for those magnetic potential values which are taken up by the shunt (or more exactly; the line correlates magnetic induction with magnetic field strengths as applied). Thus the slope value of straight line *a* is a measure of the magnetic conductance of the shunt acting as a load on the permanent magnet.

The intersection of straightline *a* and of the plotted demagnetizaton curve represents the working point (Bo; Ho) which would be applicable if the rest of the magnetic resistances of the magnet systems were infinitely high in comparison with the shunt resistance RN or if the magnet system were excited in an appropriate way. Considering, however, that these other resistances have finite values only, another straight line *b* will be applicable which runs also through the zero point and represents the resultant conductance of the magnet system as a whole. The slope of curve *b* may vary but to a small degree only corresponding to a variable airgap resistance RL for example and for different excitations.

The intersection P of the straight line *b* and of the line X determines the actual working point on the line X. The slope value of this straight line *b*, which is always higher than that of the straight line *a* during normal operation of the magnet system, may be calculated from the total of conductance values of the shunt and of the rest of the system. According to the preferred embodiment of the invention as described, the shunt itself produces a very steep *a* line, so that the steepness of line *b* will be increased to a rather limited extent only, following additional loadings of the magnet systems by airgap resistances and excitation, in other words, the working points are quite close together. Any attempt to alter the position of the working point (Bo; Ho) requires extremely powerful influences, such as for example, a very strong over excitation as it does not occur in practice. Nevertheless, it can be seen, that strong over excitations resulting, for example, in the $\mu$-characteristics Z plotted by a dotted line, could not shift the working point of the magnet system by much. Even on such shifting the magnetic potential would vary to a negligible extent only and in a lesser extent the steeper the demagnetization curve runs.

It is possible, in fact, to produce a magnetic potential source without a shunt in such a way that the internal resistance of the magnet $Ri = l/(\mu.q\cdot)$ is kept at an adequately low value. For this purpose, it is required to keep the length *l* of the magnet quite small and its cross-section *q* quite large, particularly when the $\mu$ value — as in case of oxide material H is smaller and the magnetic field strength is higher than that of other materials. Realizing these conditions leads to extremely this magnet plates with large surface, which are difficult to manufacture and in addition require a very large base for the magnet system and relay. Thus, such a magnet system would be unnecesarily bulky.

This last mentioned method has the additional disadvantage that without shunt path the total externally applied flux has to run directly across the magnet. Therefore, comparatively small magneto-motive forces or fluxes suffice to change the polarity of the magnet, or at least to shift its working point as was outlined above, particularly if the externally applied flux and the permanent flux oppose each other. The latter operating state is always true for one armature position.

In order to achieve the object of the invention, quite powerful shunts have to be used and suitable material has to be selected. In other words, this material has to provide a field strength at high flux densitites which establishes the necessary operation potential for the magnetic system, taking into consideration that a greater magnet path length is better adapted to the contour of the space occupied by the magnet system and to the manufacturing conditions for such a system.

Such material should have values and demagnetization curves which intersect a steep shunt line such as *a* (FIG. 6) at an intersection point (Bo; Ho), so that the expression ($Bo + \mu Ho$) is as high as possible, wherein $\mu$ is the permeability of the permanent magnet. As a first approximation such a material can be selected on the basis of the highest possible remanence point.

It would appear, that it is advisable to select materials with which the value of the expression ($Bo + \mu Ho$) is higher than 8000 Gauss. The value for $Bo + \mu Ho$ is the intersection of line X with the ordinate. At the present time this can be realized with high quality Al-Ni-Co materials.

These materials are also highly desirable in order to keep the magnetic potential at a constant value, as considerable values for field strength H will be present at high flux densities B. This, however, means that the (Bo; Ho) point is still in the region of adequately high field strengths, even with a very powerful shunt, so that the magnetic potential is kept constant by that shunt and the magnetic potential needed for the magnet system is provided for accordingly. Moreover, FIG. 6 illustrates that the plotted $\mu$-line X of the Al-Ni-Co material runs considerably steeper than the corresponding characteristics Y of the oxide material. This too is favorable for keeping the magnetic potential at a constant value, because the difference of the H-values of the intersections of the lines *a* and *b* with the $\mu$ lines is smaller with steep $\mu$ lines particularly when considering a given angle between lines *a* and *b*. Furthermore, the angle between lines *a* and *b* with given load variation of the magnet system is smaller, the steeper line a is running.

The invention is not limited to the embodiments described above but all changes and modifications thereof not constituting departures from the spirit and scope of the invention are intended to be included.

We claim:

1. In an electromagnet system having a permanent magnet means for energization, further having a magnetically superimposing electromagnetic energization and a magnetizable output, all being included in a magnetic circuit, the improvement for preventing weakening of the permanent magnet means comprising:

a magnet shunt path for the permanent magnet means included in the circuit and connected in parallel thereto and having width dimensions so that the internal magnetic resistance of the shunt and of the permanent magnet means combined is smaller than the sum total of the magnetic resistance of the remainder of the magnetic circuit, the permanent magnet means having a particular demagnetization curve and the shunt having a particular magnetic load characteristics resulting in a point of intersection defined by a flux $Bo$ and a magnetic field strength $Ho$, said permanent magnet means having a permeability $\mu$ so that $Bo + \mu Ho$ exceeds 8000 Gauss.

2. In an electromagnetic system as in clain 1, wherein the magnetic circuit and the magnetizable output includes an airgap, the magnetic resistance of that airgap being larger than the magnetic resistance of the remainder of the circuit.

3. In a system as in claim 1, the shunt including an adjustable airgap.

4. In a system as in claim 3, the airgap including a spacer sheet.

5. In a system as in claim 4, the sheet having different densities of magnetizable material.

6. In a system as in claim 1, wherein the shunt has decreasing magnetic resistance for increasing field strength when applied.

7. In a system as in claim 1, wherein the magnetizable output includes a pivotable armature and the circuit includes yoke means serving as stops for the armature, the yoke means including separate yoke plates magnetically interconnected by the permanent magnet means with additional connection provided by said shunt path.

8. In a system as in claim 7, wherein the shunt includes a block, the permanent magnet being inserted in the block.

9. In a system as in claim 7, wherein the permanent magnet is partially embedded in the shunt, acting as magnetic shield.

10. In a system as in claim 7, wherein the shunt is biparted with a gap between, there being a spacer sheet in said gap.

11. In a system as in claim 1, wherein the permanent magnet is made of aluminum nickel or an aluminum nickel cobalt alloy.

12. In an electromagnet system having a permanent magnet for energization and being included in a magnetic circuit which includes means for providing electromagnetic energization, further including yoke elements for magnetic conduction, the improvement of a magnetically conductive block, the permanent magnet being inserted in the block, so that the poles of the permanent magnet are in engagement with opposite ends of the block, portions of the block extending from the opposite ends alongside of said magnet and along opposite sides thereof, the block being interposed between the yoke elements whereby said ends respectively adjoin said yoke elements and serving as a shunt element, whereby the combined magnetic resistance of the shunt element and of the permanent magnet is lower than the sum total of the magnetic resistances of the remainder of the magnetic circuit.

13. In a system as in claim 12, wherein the working point of the permanent magnet is defined by a flux $Bo$ and a magnetic field strength $Ho$, and a permeability $\mu$ of the permanent magnet means so that $Bo + \mu Ho$ exceeds 8000 Gauss.

14. In a system as in claim 12, said block including a gap and sheet having a relatively high magnetic resistance in said gap.

* * * * *